US006819885B2

(12) United States Patent
Serizawa

(10) Patent No.: US 6,819,885 B2
(45) Date of Patent: Nov. 16, 2004

(54) DEVELOPER COLLECTION VESSEL AND IMAGE FORMATION APPARATUS

(75) Inventor: Masato Serizawa, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/366,448

(22) Filed: Feb. 14, 2003

(65) Prior Publication Data

US 2003/0219264 A1 Nov. 27, 2003

(30) Foreign Application Priority Data

May 23, 2002 (JP) ..... P2002-148739

(51) Int. Cl.[7] ..... G03G 21/12
(52) U.S. Cl. ..... 399/35; 399/360
(58) Field of Search ..... 399/35, 358, 359, 399/360, 98, 99, 257

(56) References Cited

U.S. PATENT DOCUMENTS 6,055,406 A * 4/2000 Kawai et al. ..... 399/360

FOREIGN PATENT DOCUMENTS

| | | | | |
|---|---|---|---|---|
| JP | 62-94883 | | 5/1987 | |
| JP | 02273777 | A * | 11/1990 | ..... G03G/21/00 |
| JP | 09325662 | A * | 12/1997 | ..... G03G/15/00 |
| JP | 11119622 | A * | 4/1999 | ..... G03G/15/01 |
| JP | 2000056648 | A * | 2/2000 | ..... G03G/15/08 |

* cited by examiner

*Primary Examiner*—Arthur T. Grimley
*Assistant Examiner*—Ryan Gleitz
(74) *Attorney, Agent, or Firm*—Morgan, Lewis & Bockius LLP

(57) ABSTRACT

A collection vessel 124 is formed with a plurality of collection spaces 148*a* to 148*f* separated by partition walls 146, and collection ports 134 and 136 are connected to the collection spaces 148*a* to 148*f*. The collection spaces 148*a* to 148*f* are made to communicate with each other through a communication part 152. A developer intake section 154 implementing a full condition detector is placed below the communication part 152. A detection vessel is placed in the developer intake section 154 for detecting a full condition based on the developer overflowing the collection spaces 148*a* to 148*f*.

17 Claims, 14 Drawing Sheets

DEVELOPER COLLECTION VESSEL AND IMAGE FORMATION APPARATUS

BACKGROUND OF THE INVENTION

1. Field of the Invention

This invention relates to a developer collection vessel for collecting a developer and an image formation apparatus comprising the developer collection vessel and in particular to an image formation apparatus comprising a full condition detector for detecting the collection vessel being full of developer.

2. Description of the Related Art

In an electrophotographic image formation apparatus applied to a printer, a copier, etc., developers to be discharged occur in a photoconductor, a transfer roll, a developing machine, etc., and need to be collected, and a collection vessel is placed. When the collection vessel becomes full of the collected developers, it should be replaced and a full condition detector is provided for detecting the collection vessel being full of developer.

Hitherto, as an image formation apparatus comprising this kind of collection vessel, an apparatus has been disclosed in JP-A-62-94883. In the related art example, a transparent or semi-transparent housing is expanded upward on the top of the collection vessel and optical sensors comprising a light emission element and a light reception element are placed on both sides of the housing. A float member is placed in the collection vessel so that it can move up and down. When a collected developer enters the collection vessel, the collected developer presses the float member and causes the float member to rise. A light shield member fixed to the float member is inserted into the housing and blocks light from the optical sensor, whereby a full condition is detected.

However, in the related art example, the full condition detector moves the float member up in response to the amount of the collected developer. Thus, if moving up of the float member is inhibited for some reason, it is made impossible to detect a full condition; developer clogging occurs and there is a fear of incurring a serious accident. Since the float member is used, there is a problem of complicating the structure.

SUMMARY OF THE INVENTION

It is therefore an object of the invention to provide a developer collection vessel and an image formation apparatus comprising a full condition detector capable of reliably detecting a full condition according to a simple configuration.

To the end, according to a first aspect of the invention, there is provided a developer collection vessel comprising a collection port to which a discharge section where a developer is discharged is connected, a collection space connected to the collection port, and at least one component of a full condition detector for detecting a full condition of developer based on the developer overflowing the collection space. Therefore, a full condition is detected based on the developer overflowing the collection space, so that a full condition can be detected reliably and the structure can also be simplified.

Preferably, one component of the full condition detector provided in the collection vessel is placed on the bottom of a collection vessel main unit. Accordingly, the effective use of space can be made and it is made possible to reduce the whole image formation apparatus. The component is formed of, for example, a translucent detection vessel, and the developer entered in the detection vessel can be detected by an optical sensor. Preferably, the detection vessel is joined with joint means that can be easily attached to and detached from the collection vessel main unit, such as adhesive tape.

According to a second aspect of the invention, there is provided a developer collection vessel comprising a plurality of collection ports to which a plurality of discharge sections where a developer is discharged are connected, a plurality of collection spaces connected to the plurality of collection ports, a communication part for communicating with the plurality of collection spaces, and at least one component of a full condition detector, placed below the communication part, for detecting a full condition of developer based on the developer overflowing any of the collection spaces. Therefore, the developers entered from the plurality of discharge sections through the collection ports in the collection spaces are piled up in the corresponding collection spaces. When the developer overflows one of the collection spaces, the developer is sent through the communication part to the full condition detector, so that only one full condition detector is required and the configuration can be simplified.

The collection capacities of the collection spaces can be defined according to the heights and shapes of the partition walls. Preferably, the collection spaces have collection capacities set so as to become almost equal to the ratio of the collected developers to be discharged for making the effective use of the space in the collection vessel. However, to reliably detect a full condition, preferably one collection space has a collection capacity set so that the developer overflows the collection space earlier than any other collection space, and the full condition detector is placed adjacent to the collection space that the developer overflows earliest.

According to a third aspect of the invention, there is provided an image formation apparatus comprising a collected developer occurrence section where developer to be collected occurs, a discharge section being connected to the collected developer occurrence section, a collection vessel having a collection port to which the discharge section is connected and a collection space connected to the collection port, and a full condition detector for detecting a full condition of developer based on the developer overflowing the collection space of the collection vessel.

The full condition detector can be made up of the detection vessel placed in the collection vessel and the sensor section placed in the image formation apparatus main unit. Preferably, the collection vessel is placed on the front of the image formation apparatus main unit. Further, preferably the detection vessel is provided with an opening/closing mechanism for opening/closing the open portion of the detection vessel in conjunction with attaching, detaching the collection vessel, so that only the collected developer when a full condition is detected is introduced into the detection vessel.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Referring now to the accompanying drawings, preferred embodiments of the invention will be description below.

Figure 1:
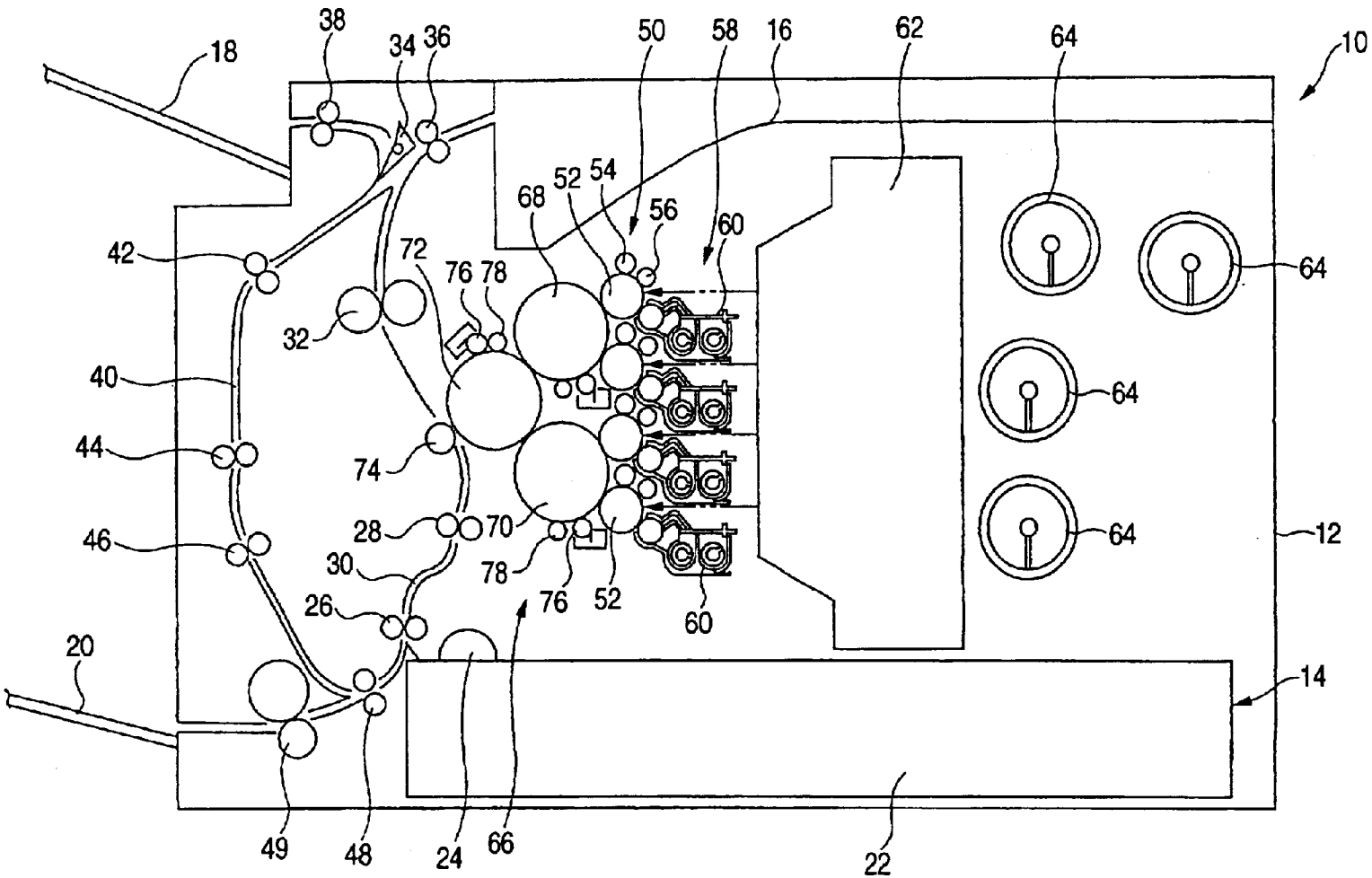
FIG. 1 is a side view to show an image formation apparatus according to an embodiment of the invention.

FIG. 1 shows an outline of an image formation apparatus 10 according to an embodiment of the invention. The image formation apparatus 10 has an image formation apparatus main unit 12, a paper feed unit 14 placed at the bottom of the image formation apparatus main unit 12, and an ejection tray 16 formed on the top of the image formation apparatus main unit 12. A second ejection tray 18 is placed on the left side of the image formation apparatus main unit 12 opposed to the first ejection tray 16, and a manual feed tray 20 is placed at a lower part of the left side of the image formation apparatus main unit 12.

The paper feed unit 14 has a paper tray 22 on which paper is stacked, and a paper feed roll 24 for delivering paper from the paper tray 22. Paper delivered by the paper feed roll 24 is transported on a paper feed passage 30 through transport rolls 26 and 28 and is sent to a transfer roll 74 described later. A toner image is transferred by the transfer roll 74 and is fixed on a fixing roll 32. The first ejection tray 16 or the second ejection tray 18 is selected in accordance with position selection of a switch claw 34 and the paper is ejected by ejection rolls 36 and 38. The paper is ejected to the first ejection tray 16 with the side on which the toner image is fixed as the back, and the paper is ejected to the second ejection tray 18 with the side on which the toner image is fixed as the face.

However, to perform double-sided print, for the paper being about to be ejected from the first ejection tray 16, the ejection roll 36 is reversely rotated for supplying the paper to a reversal passage 40 and the paper is returned to the paper feed passage 30 by transport rolls 42, 44, 46, and 48 for printing the back side. Paper on the manual feed tray 20 is supplied by a manual feed roll 49 and is sent to the paper feed passage 30 through the transport roll 48.

A photoconductor unit 50 has four photoconductors 52 arranged in a longitudinal direction for yellow, magenta, black, and cyan, for example, from the top to the bottom. A refresh roll 54 and a charging roll 56 are provided for each of the photoconductors 52 so as to come in contact with the corresponding photoconductor 52 for rotation.

A developing machine unit 58 is placed on the right of the photoconductor unit 50 and has four developing machines 60 arranged in the longitudinal direction in a one-to-one correspondence with the photoconductors 52. Each developing machine 60 adopts a trickle developing system, and an extra developer is collected into a collection vessel described later. Alight exposure unit 62 is placed on the right of the developing machine unit 58 for emitting four laser beams responsive to an image signal to the photoconductors 52 for forming a latent image thereon. Four developer cartridges 64 are placed on the right of the light exposure unit 62. The developer cartridges 64 and the developing machines 60 are connected by developer supply passages (not shown) for supplying developers from the developer cartridges 64 to the developing machines 60.

An intermediate transfer unit 66 is placed on the left of the photoconductor unit 50 and has three intermediate transfer bodies 68, 70, and 72 shaped like drums. The two first intermediate transfer bodies 68 and 70 are arranged in the longitudinal direction. The upper first intermediate transfer body 68 comes in contact with the two upper photoconductors 52 and 52 for rotation and the lower first intermediate transfer body 70 comes in contact with the two lower photoconductors 52 and 52 for rotation. The second intermediate transfer body 72 comes in contact with both the first intermediate transfer bodies 68 and 70 for rotation, and the transfer roll 74 comes in contact with the second intermediate transfer body 72 for rotation. Therefore, two color toner images are transferred from the two photoconductors 52 and 52 to the first intermediate transfer bodies 68 and 70, and the two color toner images transferred to the first intermediate transfer body 68 and the two color toner images transferred to the first intermediate transfer body 70 are transferred to the second intermediate transfer body 72 to form a four-color toner image, which is then transferred to paper by the transfer roll 74. A cleaning roll 76 and a cleaning brush 78 are placed on each of the intermediate transfer bodies 68, 70, and 72. Toner caught by the cleaning roll 76 is scraped off, for example, with a blade, and the scraped-off toner is collected into the collection vessel described later. That is, the image formation apparatus main unit 12 has the four developing machines 60 and the three intermediate transfer bodies 68, 70, and 72, namely, comprises seven collected developer occurrence sections in total.

Figure 2:
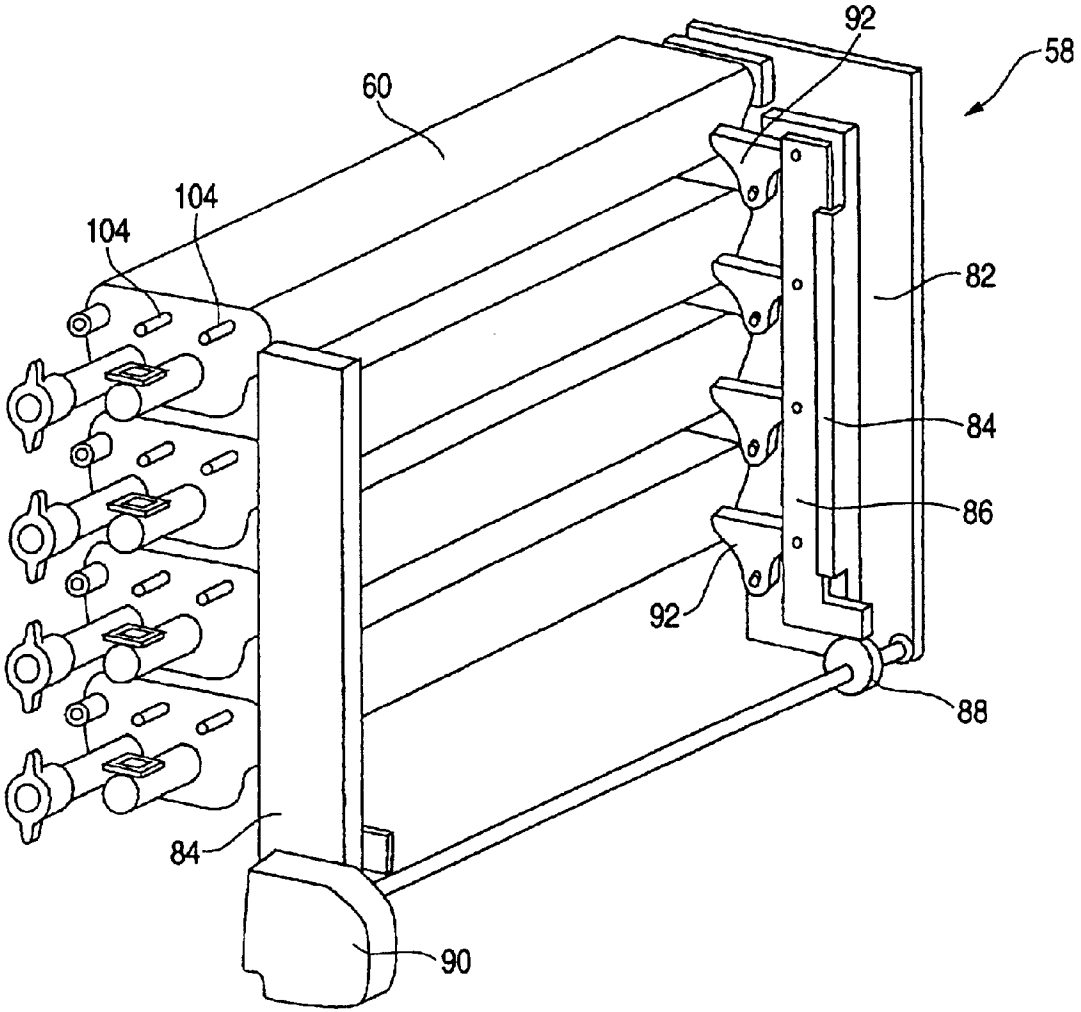
FIG. 2 is a perspective view to show a developing machine unit used with the image formation apparatus according to the embodiment of the invention.
Figure 3:
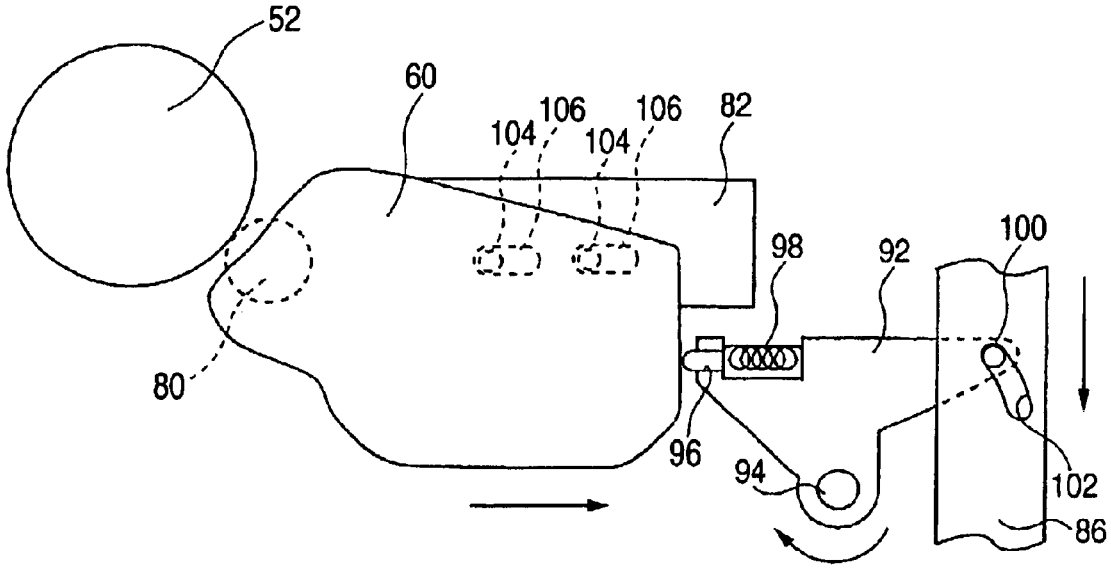
FIG. 3 is a side view to show a part of the developing machine unit used with the image formation apparatus according to the embodiment of the invention.
Figure 4:
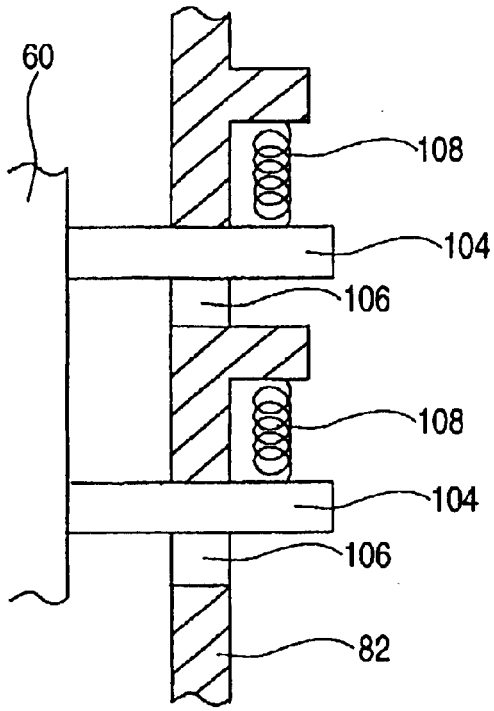
FIG. 4 is a sectional view to show apart of the developing machine unit used with the image formation apparatus according to the embodiment of the invention.

FIGS. 2 to 4 show the developing machine unit 58 in detail. The developing machine unit 58 can be moved between a position where a magnet roll 80 of the developing machine 60 abuts the photoconductor 52 and a position where the magnet roll 80 is retreated from the photoconductor 52. When an image is formed, the magnet roll 80 is abutted against the photoconductor 52 and toner is deposited on the photoconductor 52 in response to the latent image formed on the photoconductor 52. When image formation is not conducted, the magnet roll 80 of the developing machine 60 is retreated from the photoconductor 52 to prevent toner from being deposited on the photoconductor 52 to produce color mixture, for example, in a cleaning cycle or to prevent the photoconductor 52 and the magnet roll 80 from coming in contact with each other to make a scratch, etc., when the developing machine unit 58 is replaced.

The developing machine unit 58 comprises a rail member 84 in a developing machine unit main body 82, and a moving piece 86 is supported on the rail member 84 so that the moving piece 86 can be moved up and down. A cam 88 abuts the lower end of the moving piece 86 and is connected to a developing machine moving motor 90. A drive member 92 is placed between the moving piece 86 and the developing machine 60. The drive member 92 is supported on the rail member 84 through a fulcrum pin 94 for rotation and abuts the developing machine 60 through a press pin 96 placed at one end of the drive member 92, and the press pin 96 is pressed by a first press spring 98 for elastically pressing the developing machine 60. A rotation pin 100 placed at an opposite end of the drive member 92 is fitted into a reception groove formed on the moving piece 86, so that as the moving piece 86 is moved down, the drive member 92 is rotated clockwise and moves away from the developing machine 60. Slide pins 104 are placed on both sides of the developing machine 60 and are inserted slidably into slide grooves 106 made in the developing machine unit main body 82. Further, the developing machine unit main body 82 is provided with second press springs 108 for pressing the slide pins 104 in a direction in which the developing machine 60 is away from the photoconductor 52.

Therefore, if the developing machine moving motor 90 is driven from the state in FIG. 3 for moving down the moving piece 86, the drive member 92 is rotated clockwise with the fulcrum pin 94 as a supporting point for weakening the press force of the first press spring 98 against the developing machine 60, and the press force of the second press spring 108 overcomes the press force of the first press spring 98, moving the developing machine 60 away from the photoconductor 52.

Figure 5:
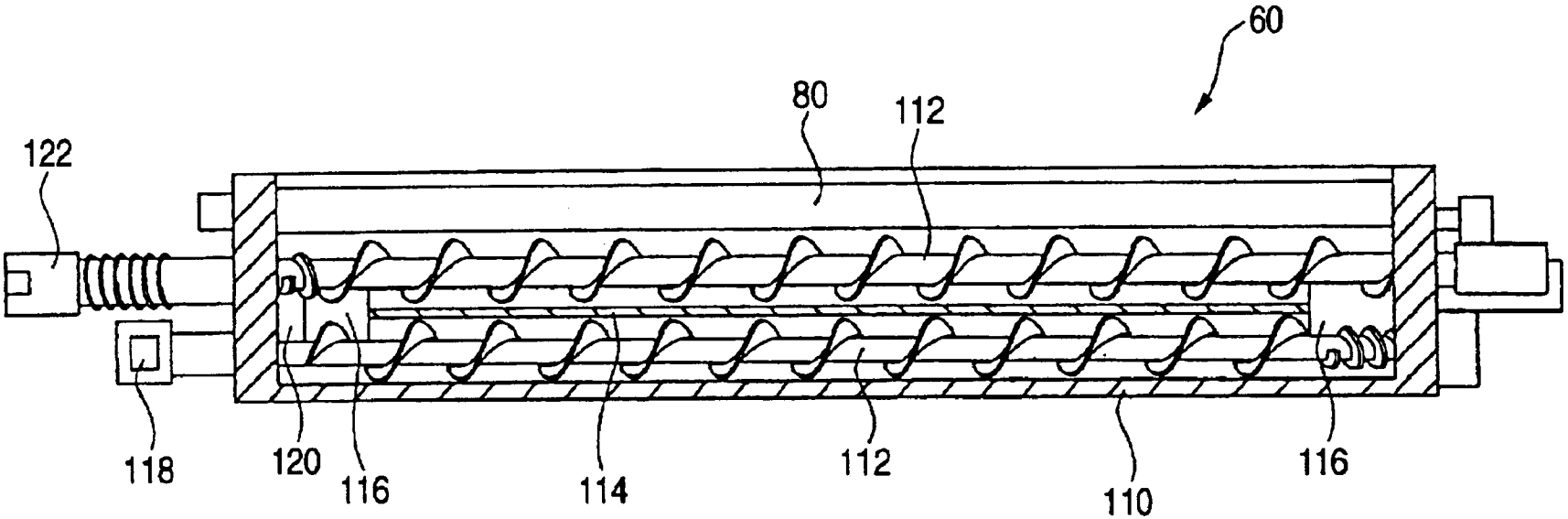
FIG. 5 is a sectional view to show a developing machine used with the image formation apparatus according to the embodiment of the invention.
Figure 6:
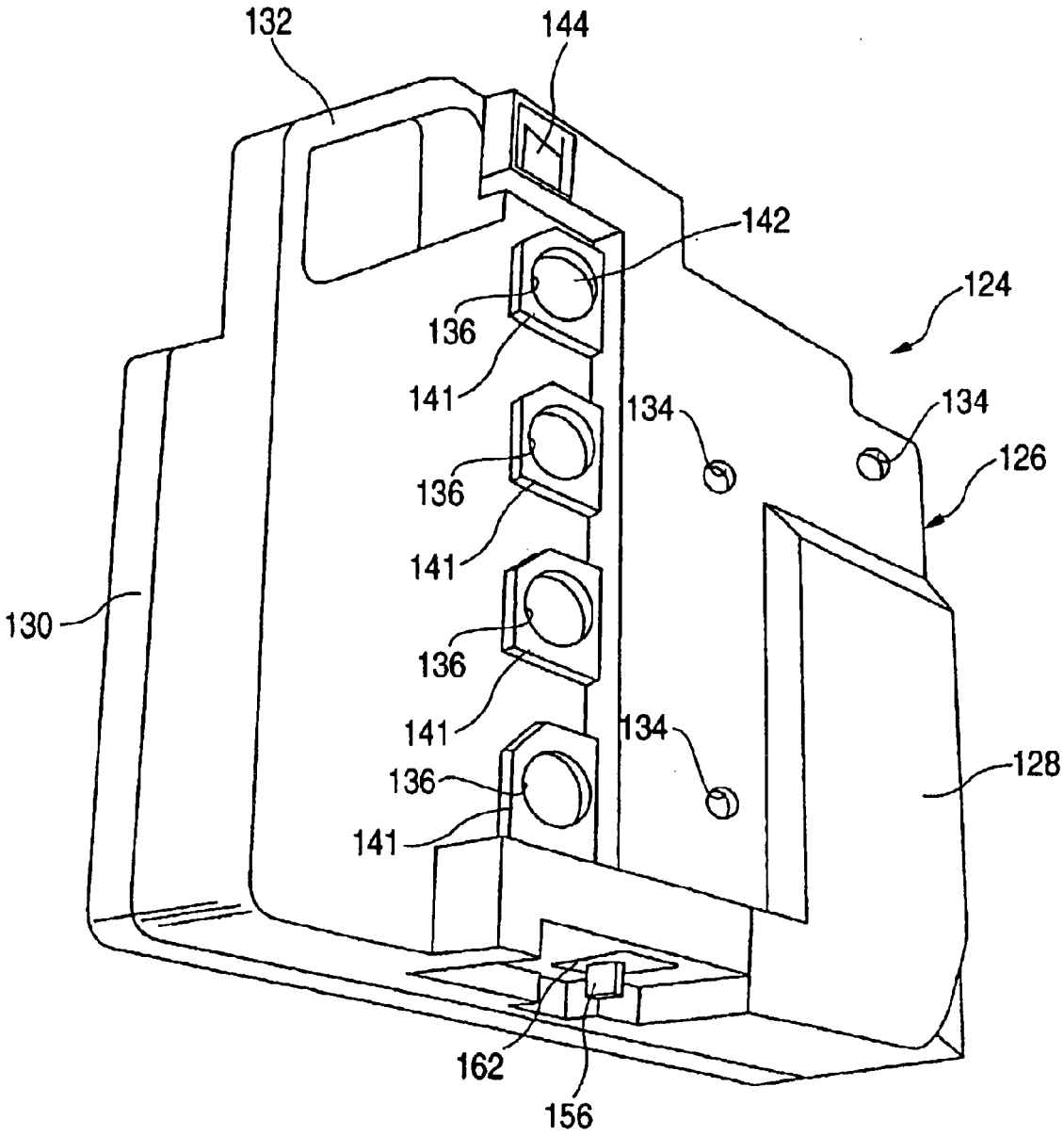
FIG. 6 is a perspective view to show the back side of a collection vessel used with the image formation apparatus according to the embodiment of the invention.
Figure 7:
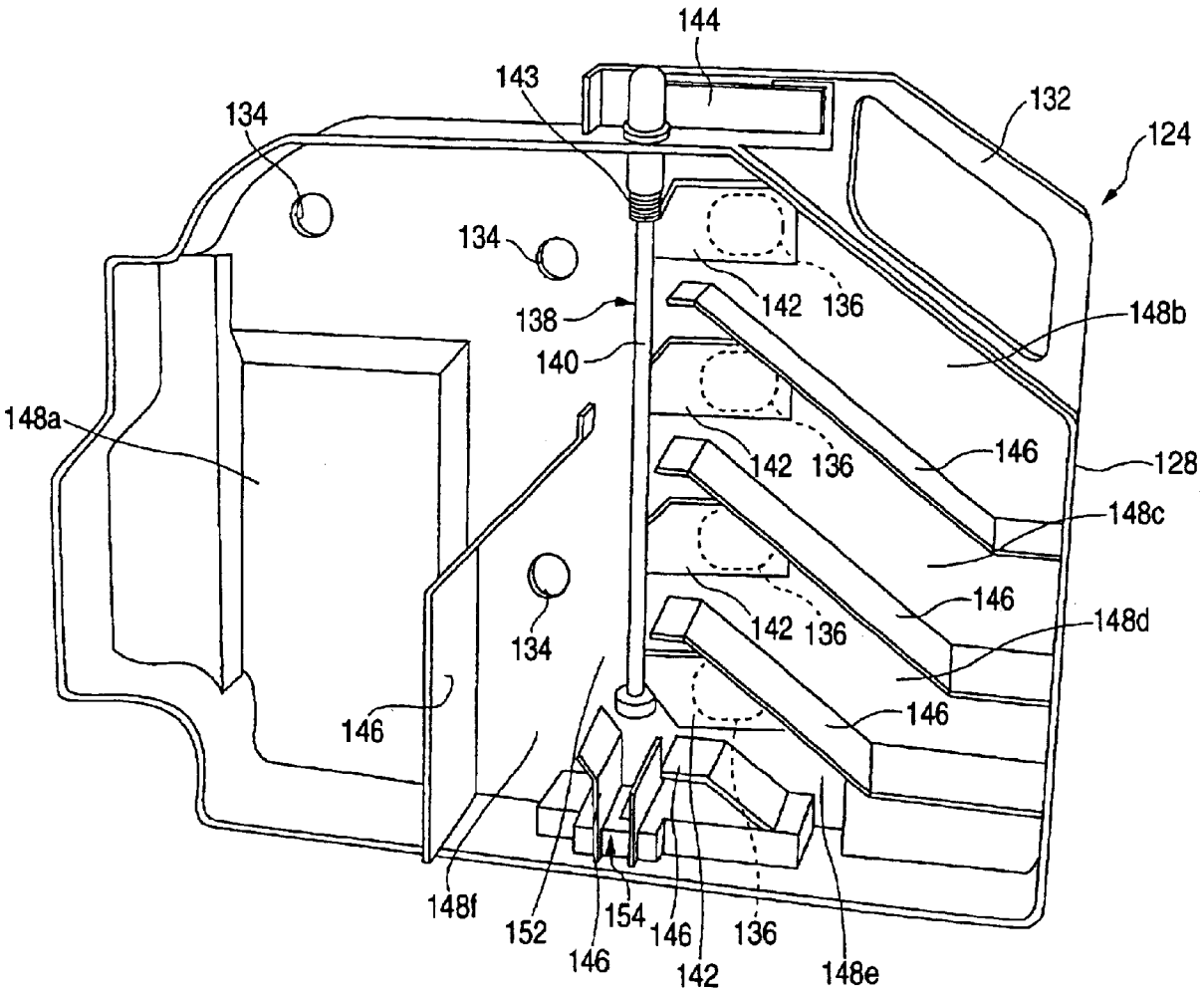
FIG. 7 is a perspective view to show a first housing of the collection vessel used with the image formation apparatus according to the embodiment of the invention.
Figure 8:
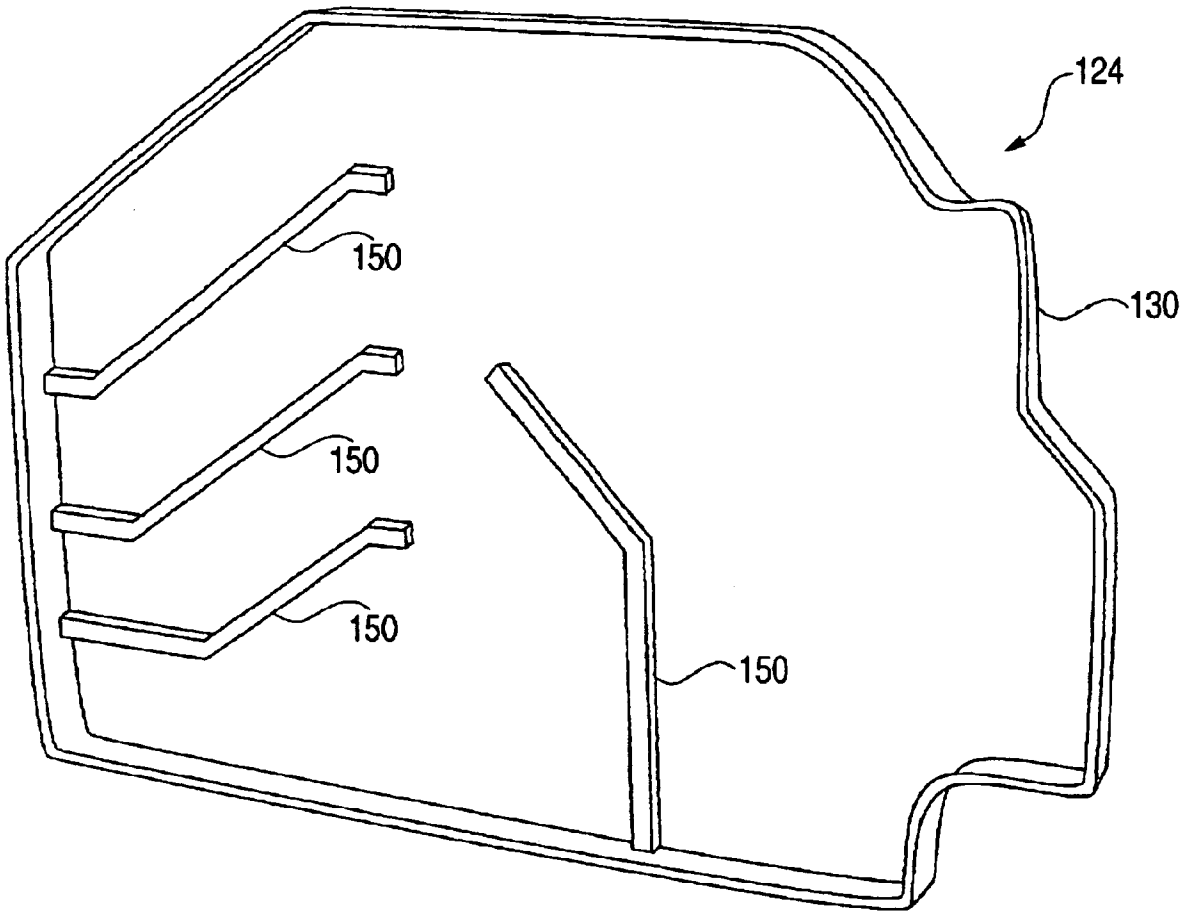
FIG. 8 is a perspective view to show a second housing of the collection vessel used with the image formation apparatus according to the embodiment of the invention.

FIG. 5 shows an example of the developing machine 6. The developing machine 60 adopts a trickle developing system as described above, and the magnet roll 80 and two spiral augers 112 are supported in a developing machine main body 110 for rotation. The two spiral augers 112 rotate in opposite directions and are partitioned by a partition wall 114 and are connected through circulation ports 116 and 116 formed in the vicinity of both end parts for circulating a developer entering the developing machine main body 110 in the developing machine main body 110 and supplying the developer to the magnet roll 80. The developing machine main body 110 is formed at one end with a step part 120 forming a collected developer occurrence section. Some of the circulated developer is taken into the step part 120 and further the taken-in developer is sent to a discharge section 122, which is connected to a collection port of the collection vessel described later.

FIGS. 6 to 9 show an example of collection vessel 124. The collection vessel 124 has a collection vessel main unit 126. The collection vessel main unit 126 is made up of a first housing 128 shown in FIG. 7 and a second housing 130 shown in FIG. 8, which are fitted into each other in peripheral portions thereof and are joined so that the collection vessel 124 can be easily disassembled and assembled with adhesive tape, etc., for example. The first housing 128 has a grip 132 in an inclined surface portion formed in the upper right part of the first housing 128. The first housing 128 is formed with three intermediate transfer body collection ports 134 corresponding to the collected developer occurrence sections of the intermediate transfer bodies and four developing machine collection ports 136 corresponding to the collected developer occurrence sections of the developing machines. One of the three intermediate transfer body collection ports 134 is formed in an upper end part of the collection vessel main unit 126; the remaining two are arranged in the longitudinal direction and one of the two intermediate transfer body collection ports 134 is formed below the longitudinal half position of the collection vessel main unit 126. The four developing machine collection ports 136 are arranged in the longitudinal direction, two of which are formed below the longitudinal half position of the collection vessel main unit 126.

Each developing machine collection port 136 is a long hole made long from side to side. The first housing 128 is provided with a shutter 138 for closing the developing machine collection ports 136. The shutter 138 has a rotation shaft 140 supported on the first housing 128 for rotation, four door parts 142 fixed to the rotation shaft 140, and a return spring 143 for urging the shutter 138 in a closing direction, and can open and close the four developing machine collection ports 136 by one operation as the rotation shaft 140 is rotated. An opening/closing piece 144 is provided in a projection portion of the rotation shaft 140 from the first housing 128. The opening/closing piece 144 is pressed by a protrusion of the image formation apparatus main unit, opening the shutter 138 as described later.

On the outer peripheral surface of each developing machine collection port 136, an elastic body 141 of a sponge, etc., for preventing a developer from spilling is attached to the first housing 128.

The inside of the collection vessel main unit 126 is divided into six collection spaces 148*a* to 148*f*, for example, by partition walls placed upright in the first housing 128. A side end part of the partition wall 146 abuts a seal part 150 placed in the second housing 130. The seal part 150 is made of an elastic body and as the side end part of the partition wall 146 abuts the seal part 150, the side part 150 hermetically seals a side part of each collection space 148*a* to 148*f* for preventing the developer in the collection space from moving to any other collection space. The intermediate transfer body collection ports 134 and 134 placed in the upper parts are connected to the first collection space 148*a* for collecting collected developers occurring from the upper first intermediate transfer body 68 and the second intermediate transfer body 72 (two color toners and four color toners). The developing machine collection ports 136 are connected to the second to fifth collection spaces 148*b* to 148*e* for collecting yellow developer (yellow toner and carrier) into the second collection space 148*b*, magenta developer (magenta toner and carrier) into the third collection space 148*c*, black developer (black toner and carrier) into the fourth collection space 148*d*, and cyan developer (cyan toner and carrier) into the fifth collection space 148*e*. Further, the intermediate transfer body collection port 134 placed in the lower part is connected to the sixth collection space 148*f* for collecting collected developer occurring from the lower first intermediate transfer body 70 (two color toners). Therefore, to collect the collection vessel 124, the collected developers are separated according to the type of developer and it is convenient to reuse the developers.

The partition walls 146 may be those for completely hermetically sealing the collection spaces 148*a* to 148*f*. In the embodiment, however, the tip of each partition wall 146 stops in the vicinity of the rotation shaft 140 of the shutter 138 and thee collection spaces communicate through a communication part 152 formed in the collection vessel main unit 126 in the vicinity of the rotation shaft 140. The tip of the partition wall 146 is positioned below the lower end of the collection port 134, 136. Therefore, the developer collected through the collection port 134, 136 piles up from the lower end of the collection space 148*a* to 148*f*, and is stored therein until a part of the developer spills from the tip of the partition wall 146. The developer capacity until the developer spills from the collection space 148*a* to 148*f* is called collection capacity. The collection capacities of the collection spaces 148*a* to 148*f* are defined based on the shapes and heights of the partition walls 146; they are set so as to become a collection capacity ratio almost equal to the ratio of the collected developers occurring in the seven collected developer occurrence sections. In the embodiment, the collection capacity ratio of the first collection space 148*a*, the total of the second to fifth collection spaces 148*b* to 148*e*, and the sixth collection space 148*f* is set to about 5:4:1 provided that the sixth collection space 148*f* first becomes full.

In the embodiment, the collection spaces 148*a* to 148*f* are made to communicate through the communication part 152 at the tips of the partition walls 146. However, as another embodiment, the partition wall 146 may be formed with a hole, a groove, etc., for allowing the collection space to communicate with any other collection space and it is not necessary to make all collection spaces communicate with each other; it may be sufficient to make at least two collection spaces communicate with each other.

Figure 9:
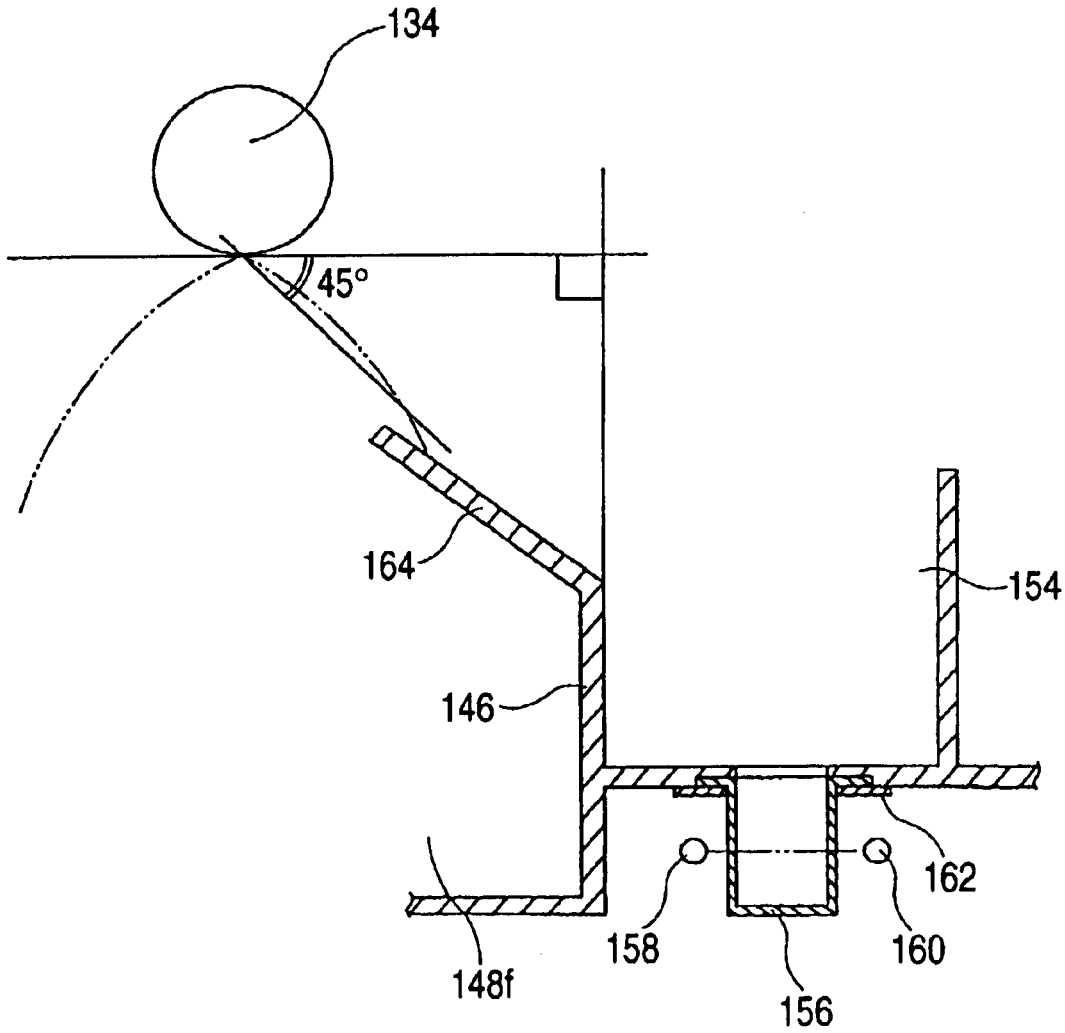
FIG. 9 is a sectional view to show a part of the collection vessel used with the image formation apparatus according to the embodiment of the invention.

A developer intake section 154 implementing a full condition detector is placed in a bottom portion of the collection vessel main unit 126 so as to be adjacent to the sixth collection space 148*f* in a lower part of the communication part 152. The developer intake section 154 has a translucent detection vessel 156 as shown in FIG. 9. When a given amount or more of developer is entered in the detection vessel 156, light emitted from a light emission section 158 placed in the image formation apparatus main unit is blocked and is not received at a light reception section 160, whereby the full condition detector detects the collection space becoming full. The detection vessel 156 is joined by joint means 162 that can be easily attached and detached, such as adhesive tape. When the collection vessel 124 is taken out from the image formation apparatus main unit 12, for example, in a maintenance work, if the developer flows into the detection vessel 156 by mistake, the detection vessel 156 can be easily removed by the joint means 162 and can be cleaned for reuse.

As shown in FIG. 9, the partition wall 146 defining the collection capacity of the sixth collection space 148*f* has a slope part 164 with a tip directed to the collection port 134, and is formed so that the tip of the partition wall 146 is positioned in the range below the 45-degree line from the horizontal line with the top of the developer as the start point when the top of the developer piled up in the sixth collection space 148*f* reaches the lower end of the collection port 134. The slope part 164 is formed so as to go to the collection port 134 at an angle of less than 90 degrees from the horizontal line. Therefore, the collected developer which is about to fill the collection space is guided from the tip of the partition wall 146 through the slope part 164 to the developer intake section 154 before the collected developer reaches the lower end of the collection port 134; the full condition detector can reliably detect the collection space being full of the developer and an accident clogging the developer, etc., can be prevented.

As described above, the collection capacity ratio of the collection spaces 148*a* to 148*f* is set so that the sixth collection space 148*f* first becomes full. However, if variation in the collection amounts or an unexpected event occurs in the image formation apparatus main unit, any other collection space 148*a* to 148*e* may become full earlier than the sixth collection space 148*f*. Even in this case, the developer overflowing any other collection space 148*a* to 148*e* can be introduced into the developer intake section 154 through the communication part 152, and a full condition can be detected reliably.

Next, attaching the collection vessel 124 to the image formation apparatus main unit 12 will be discussed with reference to FIGS. 10 to 14.

Figure 10:
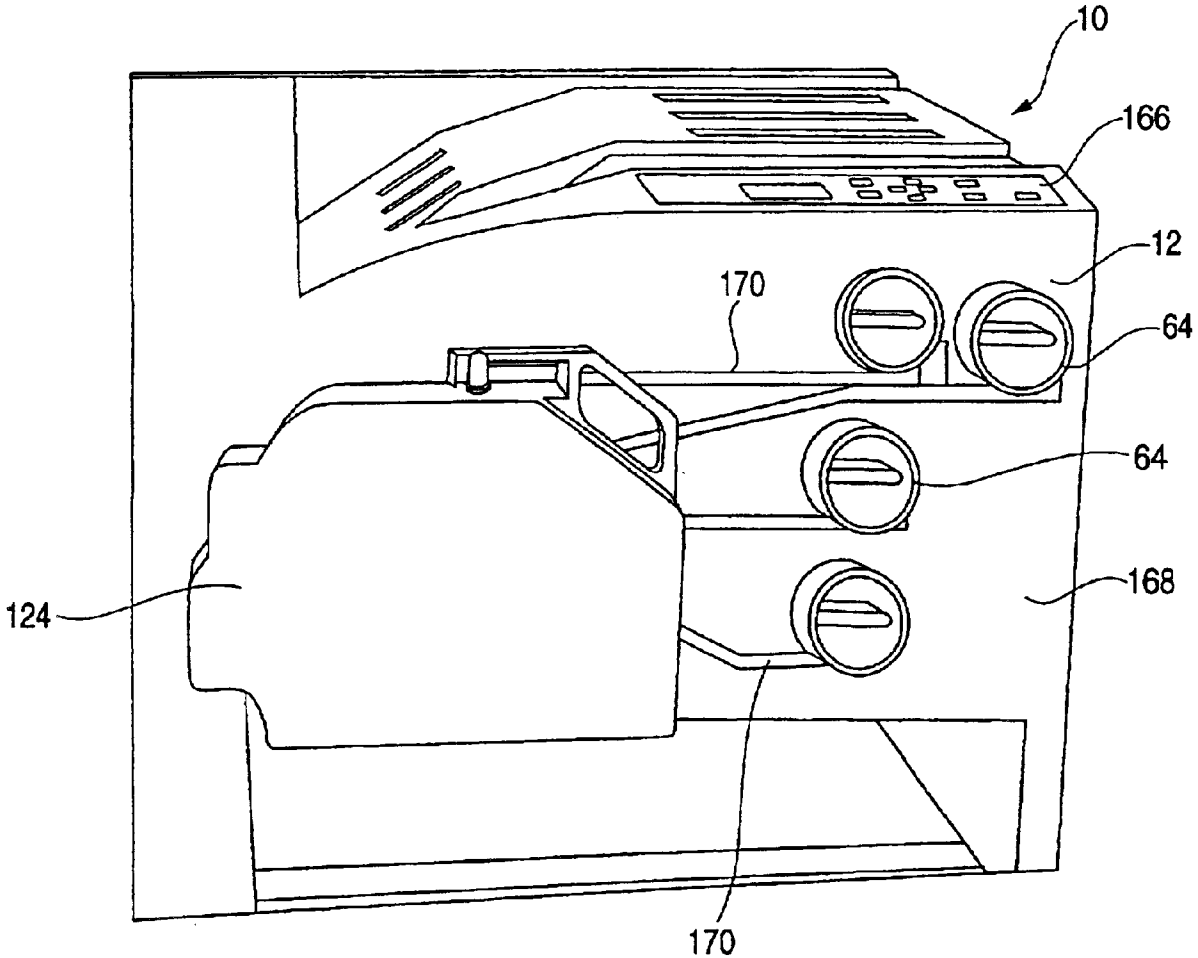
FIG. 10 is a perspective view to show a state of placing the collection vessel on an image formation apparatus main unit with a front panel removed in the image formation apparatus according to the embodiment of the invention.
Figure 11:
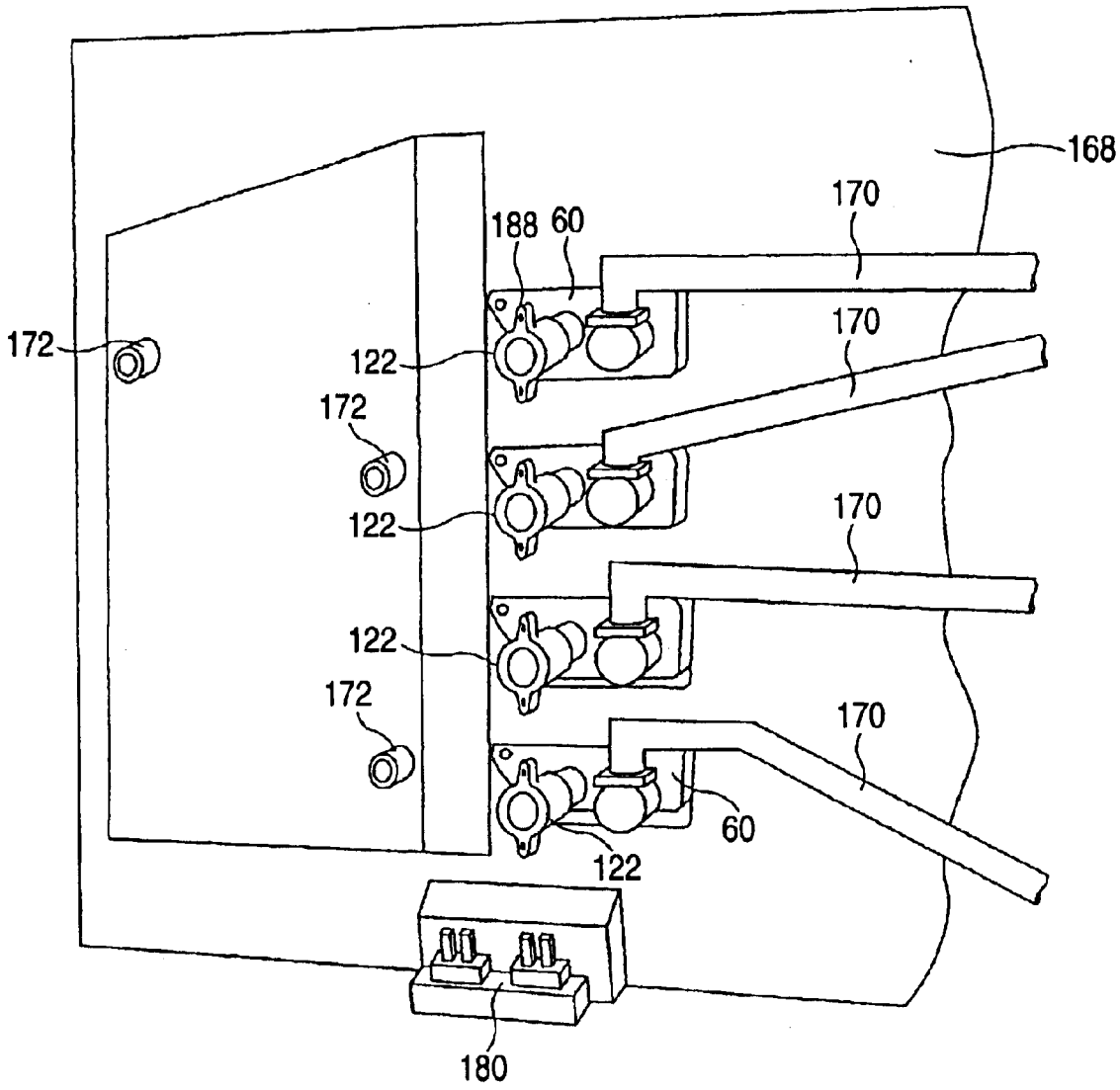
FIG. 11 is a perspective view to show the image formation apparatus main unit excluding a front panel, the collection vessel, and a second frame in the image formation apparatus according to the embodiment of the invention.
Figure 12:
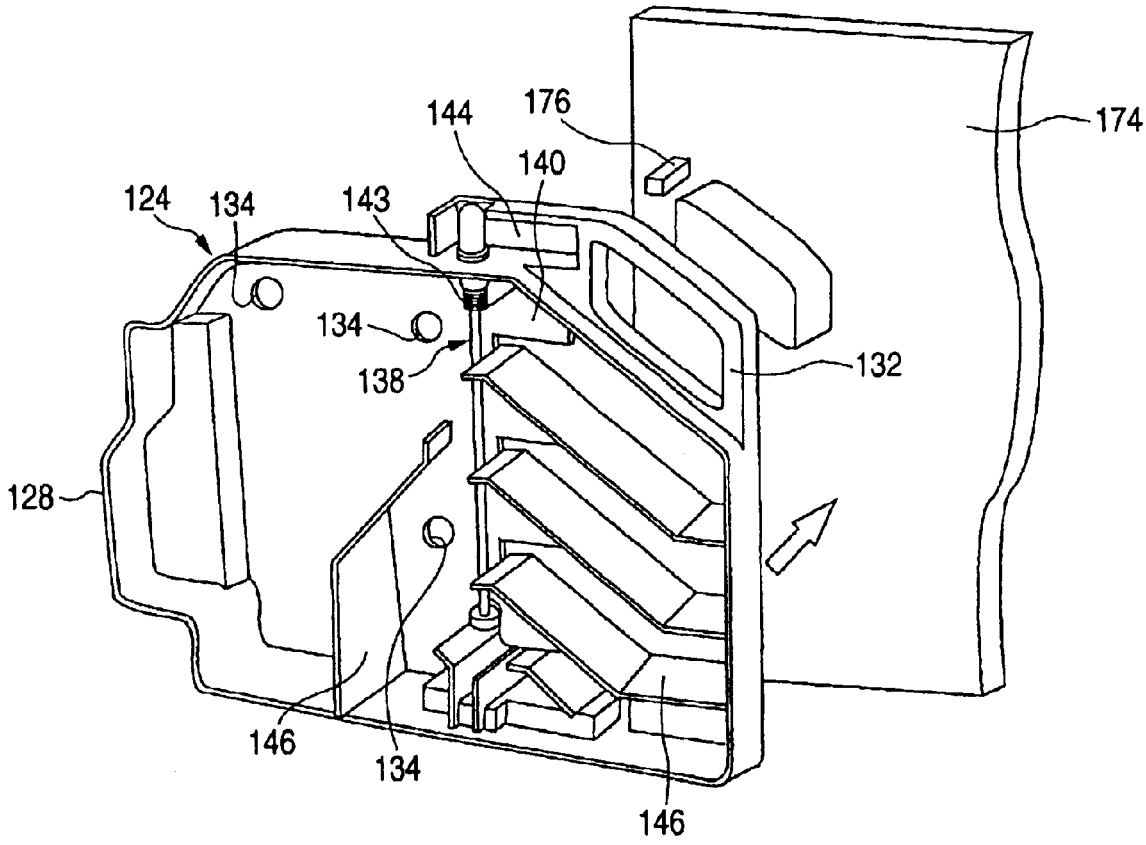
FIG. 12 is a perspective view to show the relationship between the collection vessel and a second frame in the image formation apparatus according to the embodiment of the invention.
Figure 13:
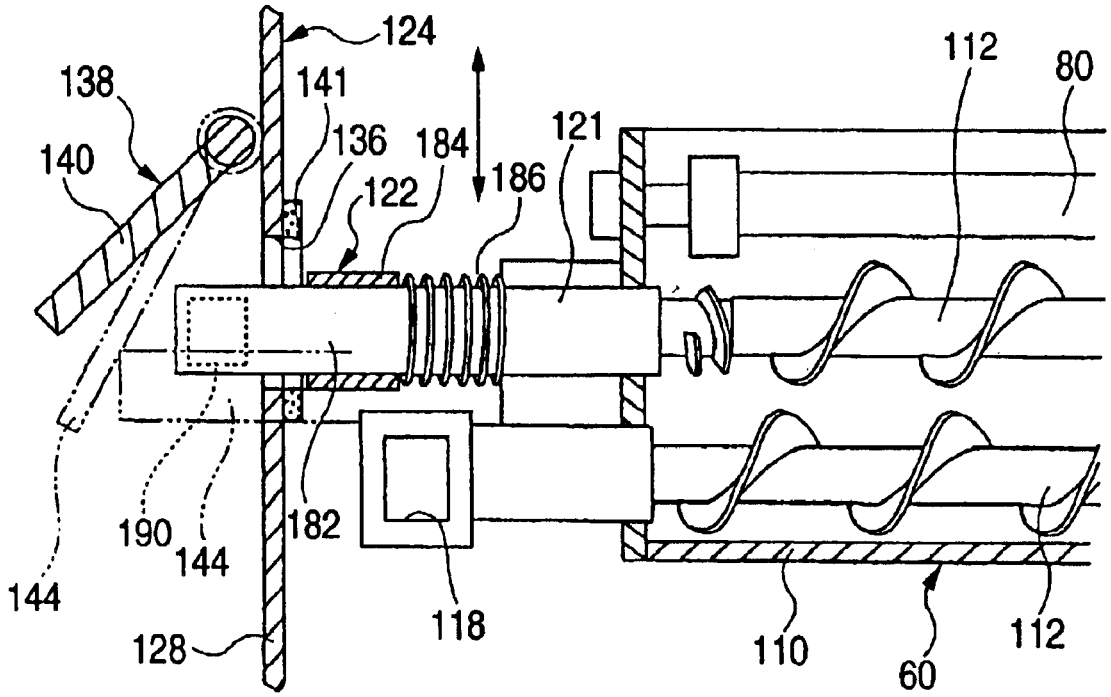
FIG. 13 is a transverse sectional view to show the relationship between a developing machine and the collection vessel in the image formation apparatus according to the embodiment of the invention.
Figure 14:
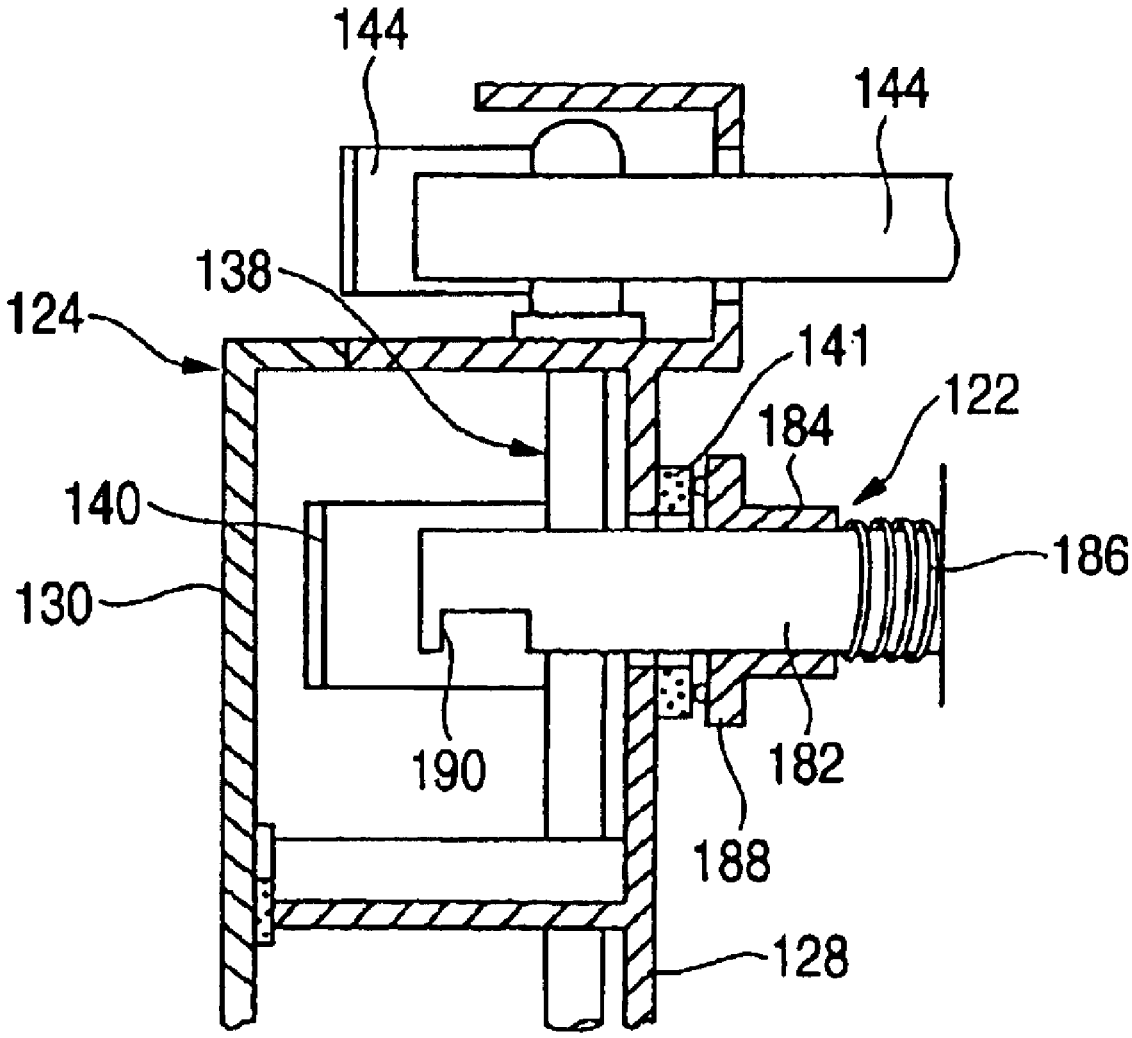
FIG. 14 is a longitudinal sectional view to show the relationship between the developing machine and the collection vessel in the image formation apparatus according to the embodiment of the invention.

The collection vessel 124 is attached to the front of the image formation apparatus main unit 12. Here, the front of the image formation apparatus main unit 12 refers to the face on which a control panel 166 is placed, as shown in FIG. 10. As a front cover (not shown) is opened, the collection vessel 124 can be found and can be attached and detached. The image formation apparatus main unit 12 is provided with a first frame and developer supply hoses 170 are placed along the first frame 168. Each developer supply hose 170 forms a developer supply passage for connecting the corresponding developing machine 60 and the corresponding developer cartridge 64. From the first frame 168, the discharge sections 122 of the developing machines 60 and discharge sections 174 connected to cleaning roll parts of the intermediate transfer unit are projected toward the front of the image formation apparatus main unit 12 almost in parallel, and are connected to the collection ports 134 and 136 of the collection vessel 124.

A second frame 174 is fixed to the front of the first frame 168 and is formed with a protrusion 176. The protrusion 176 is placed facing the opening/closing piece 144 of the shutter 138 in the collection vessel 124. To place the collection vessel 124 on the image formation apparatus main unit 12, the protrusion 176 abuts the opening/closing piece 144 and presses the opening/closing piece 144 in a direction opening the shutter 138, opening the shutter against the return spring 143. A sensor section 180 forming the full condition detector is placed in a lower part of the first frame 168.

The protrusion 174 is formed on the image formation apparatus main unit 12, but may be formed on the shutter 138 as another embodiment. The protrusion 176 can be provided on the front cover and the shutter 134 can also be opened and closed in conjunction with opening and closing the front cover.

The discharge section 122 of each developing machine 60 has a discharge pipe 182, an open/close sleeve 184 slidably externally fitted into the discharge pipe 182, and an opening/closing spring 186 for pressing the open/close sleeve 184 in the tip direction. To place the collection vessel 124 on the image formation apparatus main unit 12, a flange 188 formed on the open/close sleeve 184 abuts the elastic body 141 of the collection vessel 124, the open/close sleeve 184 backs against the opening/closing spring 186, the tip of the discharge pipe 182 is inserted into the collection vessel 124 from the developing machine collection port 136, and a discharge port 190 formed in the vicinity of the tip of the discharge pipe 182 is opened, allowing the collected developer from the developing machine 60 to be collected into the collection vessel 124 through the discharge port 190.

The discharge sections 122 of the developing machines 60 are thus connected to the collection vessel 124. At this time, the shutter 138 is already opened by the protrusion 176 and the discharge sections 122 do not abut the door parts 142 of the shutter 138.

However, the collection vessel 124 is not necessarily placed straightly on the image formation apparatus main unit 12. Thus, to place the collection vessel 124 slantingly on the image formation apparatus main unit 12, the tips of the discharge pipes 182 of the discharge sections 122 first abut the door parts 142 and the shutter 138 is opened so as not to hinder opening the shutter 138.

Further, then the developing machines 60 are moved in the photoconductor direction as described above. Also at this time, the shutter 138 is opened to the angle at which the discharge sections 122 do not abut the door parts 142 of the shutter 138. Therefore, a force of hindering motion of the developing machines 60 does not act from the shutter 138 and the developing machines 60 can be moved smoothly.

The operation of the image formation apparatus 10 according to the embodiment is as follows:

Upon reception of an external image formation signal, for example, the paper feed roll 24 of the paper feed unit 14 works and paper is sent from the paper feed tray 22 via the paper feed passage 30 to the transfer roll 74. On the other hand, the four rotating photoconductors 52 are uniformly charged by the charging rolls 56, laser light from the light exposure unit 62 is received in response to an image signal, and a latent image is formed. Next, color toner images are formed by the developing machines 60 and two colors are transferred to the first transfer body 68 and two colors are transferred to the first transfer body 70. Further, the four colors are transferred to the second intermediate transfer body 72 to form a four-color toner image, which is then transferred to paper by the transfer roll 74. The toner image transferred to the paper is fixed on the paper as the paper passes through the fixing roll 32, and the paper is discharged to the first ejection tray 16 or the second ejection tray 18.

In the developing machine 60, a little excessive developer is supplied from the developer cartridge 64 to a developer entrance 118 in response to the developer consumption amount. The supplied developer is circulated in the developing machine main unit 110 by the spiral augers 112 and is supplied to the magnet roll 80. The extra developer is caught by the step part 120 and is collected through the discharge section 122 into the collection vessel 124. The toners deposited on the intermediate transfer bodies 68, 70, and 72 are caught by the cleaning rolls 76 and are collected through the discharge sections 172 into the collection vessel 124.

The developers thus collected into the collection vessel 124 are stored separately in the collection spaces 148*a* to 148*f* in the collection vessel 124. When the developer collection amount of the collection spaces 148*a* to 148*f* becomes a predetermined amount or more (usually, the developer collection amount of the collection space 148*f* becomes a predetermined amount or more), the developer overflows the partition wall 146 and moves to the developer intake section 154. The developer entering the developer intake section 154 moves to the detection vessel 156. The sensor section 180 detects the collection space becoming full, and sends a detection signal to a control section of the image formation apparatus main unit 12 for displaying a full condition on the control panel 166, for example. Accordingly, the user can replace the collection vessel 124 with a new one for making it possible to again conduct image formation.

If the collection vessel 124 is detached from the image formation apparatus main unit 12 in a state in which the collection vessel 124 (collection space) is not full and the collection vessel 124 is inclined, the developer spills from the partition wall 146 of the collection space 148*a* to 148*f* and enters the detection vessel 156. If the collection vessel 124 is later placed on the image formation apparatus main unit 12, a full condition may be detected. However, if the collection vessel 124 is once detached and again is attached to the image formation apparatus, the developer in the collection vessel gathers in one collection space and there is a fear of leading to an accident of developer clogging, etc., in the image formation apparatus main unit 12; preferably a full condition. is displayed for prompting the user to replace the collection vessel 124.

Figure 15:
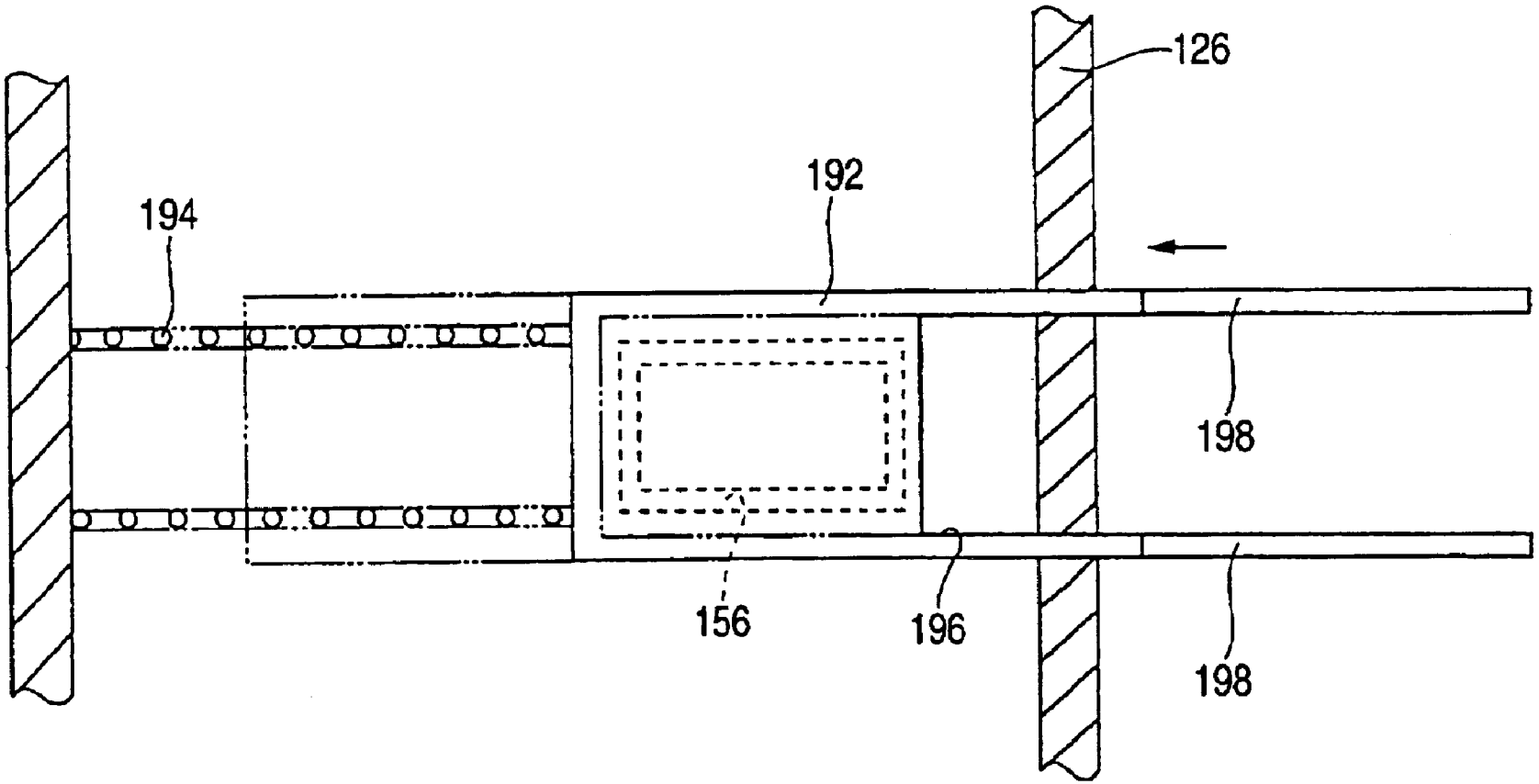
FIG. 15 is a sectional view to show the detection vessel vicinity where opening/closing means is placed in a developer collection vessel according to another embodiment of the invention.

FIG. 15 shows another embodiment of the invention. In this embodiment, opening/closing means is provided in an upper open portion of the detection vessel 156 described above. The opening/closing means is, for example, of slide type, and a slide member 192 is placed slidably relative to collection vessel main unit 126. The slide member 192 is urged by a spring member 194 in the placement direction of collection vessel, and is formed with a window 196 and press parts 198. The press parts 198 project from the collection vessel main unit 126 to image formation apparatus main unit. To place the collection vessel on the image formation apparatus main unit, the press parts 198 abut a frame of the image formation apparatus main unit, the slide member 192 moves against the spring member 194, and the top of the detection vessel 156 is opened through the window 196, enabling developer to enter the detection vessel 156. On the other hand, to detach the collection vessel from the image formation apparatus main unit, the top of the detection vessel 156 is closed by the slide member 192, preventing the developer from flowing into the detection vessel 156. Therefore, to attach and detach the collection vessel in maintenance, etc., the developer can be prevented from flowing into the detection vessel 156, so that it is made possible to facilitate maintenance work and the reliability of detecting a full condition can also be provided.

In the embodiment, the image formation apparatus of the type wherein the collected developer occurrence sections are placed in the developing machines and the intermediate transfer bodies has been described. However, the collected developer occurrence sections are not limited to them; for example, collected developers occurring in the photoconductors, the transfer roll, etc., may be collected. The full condition detector adopts the technique of optically detecting the collection vessel being full of developer, but any detection technique, such as a magnetic, electric, or mechanical technique, may be used.

As described above, according to the invention, in the developer collection vessel, the developer overflowing the collection space is detected, whereby a full condition is detected, so that a full condition can be detected reliably and the full condition detector can be simplified.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A developer collection vessel comprising:

a plurality of collection ports to which a plurality of discharge sections where developers are discharged are connected, each of the plurality of discharge sections for discharging respective types of developer;

a plurality of collection spaces connected to said collection ports; and at least one component of a full condition detector for detecting a full condition of developer based on the developer overflowing any of said collection spaces.

2. The developer collection vessel as claimed in claim 1 wherein said component is placed on a bottom of a collection vessel main unit.

3. The developer collection vessel as claimed in claim 1 wherein said component is formed of a translucent detection vessel for optically detecting the developer entered in the detection vessel.

4. The developer collection vessel as claimed in claim 3 further comprising a unit adapted to open and close an open portion of the detection vessel.

5. The developer collection vessel as claimed in claim 4 wherein the unit opens and closes the open portion of the detection vessel in conjunction with attaching and detaching said collection vessel.

6. The developer collection vessel as claimed in claim 3 further comprising a joint unit adapted to join the detection vessel, the joint unit being attached to and detached from the collection vessel main unit.

7. A developer collection vessel comprising:

a plurality of collection ports to which a plurality of discharge sections where developers are discharged are connected, each of the plurality of discharge sections for discharging respective types of developer;

a plurality of collection spaces connected to said plurality of collection ports;

a communication part for communicating with said plurality of collection spaces; and at least one component of a full condition detector, placed below said communication part, for detecting a full condition of developer based on the developer overflowing any of said collection spaces.

8. The developer collection vessel as claimed in claim 7 wherein at least one of said plurality of collection spaces has a collection capacity defined based on the height of a partition wall for separating said collection space.

9. The developer collection vessel as claimed in claim 8 wherein the partition wall is positioned below said collection ports connected to said collection spaces separated by the partition wall.

10. The developer collection vessel as claimed in claim 9 wherein the partition wall has a tip defining the height of the partition wall, placed in a range below a 45-degree line from the horizontal line with the top of developer as the start point when the top of the developer piled up in the collection space reaches said collection port.

11. The developer collection vessel as claimed in claim 7 wherein at least one of said plurality of collection spaces has a collection capacity defined based on the shape of a partition wall for separating said collection space.

12. The developer collection vessel as claimed in claim 11 wherein the partition wall has a slope part going to said collection port at an angle of less than 90 degrees from the horizontal line.

13. The developer collection vessel as claimed in claim 7 wherein said plurality of collection spaces have collection capacities set so that a ratio of the collection capacities becomes almost equal to a ratio of amounts of the developers to be discharged.

14. The developer collection vessel as claimed in claim 7 wherein one of said plurality of collection spaces has a collection capacity set so that the developer overflows said collection space earlier than any other collection space.

15. The developer collection vessel as claimed in claim 14 wherein the component of the full condition detector is placed adjacent to said collection space that the developer overflows earliest.

16. An image formation apparatus comprising:

a plurality of collected developer occurrence sections where developer to be collected occurs, each of the plurality of collected developer occurrence sections for collecting respective types of developer;

a plurality of discharge sections being connected to said collected developer occurrence sections;

a collection vessel having a plurality of collection ports to which said discharge sections are connected and a plurality of collection spaces connected to the collection ports; and a full condition detector for detecting a full condition of developer based on the developer overflowing any of the collection spaces of said collection vessel.

17. The image formation apparatus as claimed in claim 16 wherein said collection vessel is placed on the front of an image formation apparatus main unit.

* * * * *